US007454936B2

(12) United States Patent
Michel et al.

(10) Patent No.: US 7,454,936 B2
(45) Date of Patent: Nov. 25, 2008

(54) METHOD AND DEVICE FOR FORMING AN ESSENTIALLY FLAT METAL BLANK TO PRODUCE A THIN-WALLED, SHELL-TYPE BODY, AND THE USE OF SAME

(75) Inventors: Helmut Michel, Esslingen (DE); Wulf Radtke, Planegg (DE); Johannes Hegels, Munich (DE)

(73) Assignee: MT Aerospace AG, Augsburg (DE)

( * ) Notice: Subject to any disclaimer, the term of this patent is extended or adjusted under 35 U.S.C. 154(b) by 0 days.

(21) Appl. No.: 11/437,814

(22) Filed: May 22, 2006

(65) Prior Publication Data

US 2007/0039366 A1 Feb. 22, 2007

(30) Foreign Application Priority Data

May 30, 2005 (DE) ..... 10 2005 024 627

(51) Int. Cl.

| | |
|---|---|
| ***B21B 27/06*** | (2006.01) |
| ***B21J 5/04*** | (2006.01) |
| ***B21D 39/08*** | (2006.01) |
| ***B21D 15/06*** | (2006.01) |
| ***B21D 5/00*** | (2006.01) |
| ***B21D 37/16*** | (2006.01) |

(52) U.S. Cl. ..... 72/69; 72/54; 72/57; 72/60; 72/83; 72/342.1

(58) Field of Classification Search ..... 72/38, 72/54, 57, 69, 342.1, 342.94, 364, 82–84, 72/60

See application file for complete search history.

(56) References Cited

U.S. PATENT DOCUMENTS

| | | | | |
|---|---|---|---|---|
| 3,572,071 | A * | 3/1971 | Semplak et al. | 72/54 |
| 5,218,849 | A * | 6/1993 | Sieger et al. | 72/69 |
| 5,426,964 | A * | 6/1995 | Sieger | 72/81 |
| 5,687,599 | A * | 11/1997 | Donaldson et al. | 72/62 |
| 6,923,030 | B2 * | 8/2005 | Kruger et al. | 72/57 |

FOREIGN PATENT DOCUMENTS

| | | |
|---|---|---|
| DE | 2 117 950 | 10/1972 |

* cited by examiner

*Primary Examiner*—Derris H. Banks
*Assistant Examiner*—Teresa Bonk
(74) *Attorney, Agent, or Firm*—Rothwell, Figg, Ernst & Manbeck, P.C.

(57) ABSTRACT

The invention relates to a vacuum-assisted method and a device for forming an essentially flat blank (12) of metal into a thin-walled, shell-type body (14), especially for performing the method in accordance with one of the preceding claims, that has a supporting structure (16) forming a mold chamber (18) that holds the blank (12) during increasing deformation into the thin-walled, shell-body (14), a device (20) allocated to the supporting structure (16) for clamping the blank (12) about its circumference (22) to the supporting structure (16), that seals the reverse face (24) of the blank (12) facing towards the mold chamber (18) against the front face (26) of the blank (12) facing away from the mold chamber (18), and a device (28) allocated to the mold chamber (18) that also communicates with the mold chamber (18) for applying a vacuum and evacuating the mold chamber (18), and at least one forming tool (50) applied to the front face (26) of the blank (12) is/are allocated to the supporting structure (16), and the use of same.

38 Claims, 7 Drawing Sheets

Figure 1:
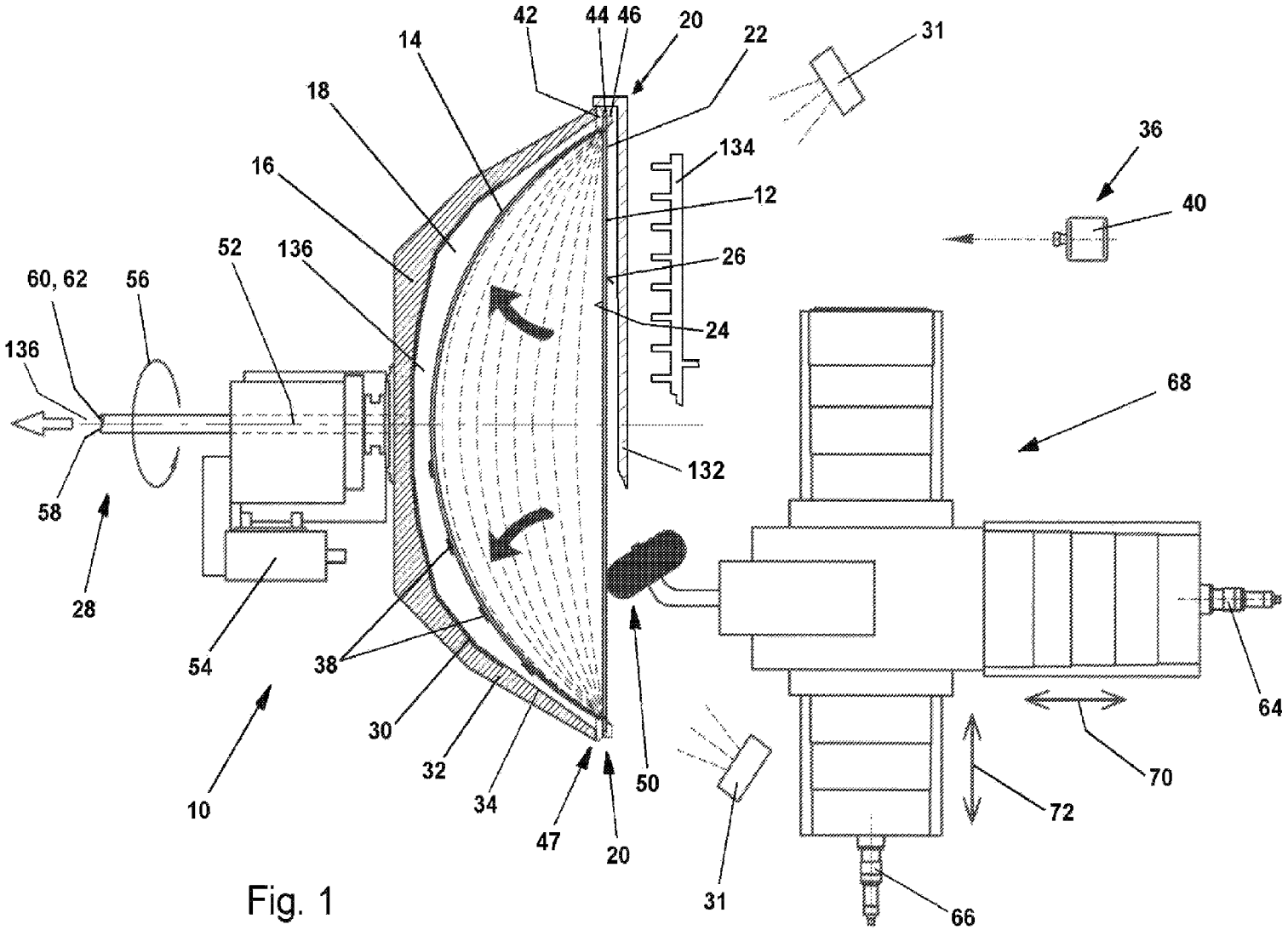

METHOD AND DEVICE FOR FORMING AN ESSENTIALLY FLAT METAL BLANK TO PRODUCE A THIN-WALLED, SHELL-TYPE BODY, AND THE USE OF SAME

DESCRIPTION

This invention relates to a method and a device for forming an essentially flat metal blank to produce a thin-walled, shell-type body, and the use of same.

Such methods and devices for the production of shell-type bodies from essentially flat blanks, round blanks or similar sheets are generally known, but overall have a number of disadvantages that are to some extent considerable.

During bottom pressing, a round blank is positioned on a draw ring and, by means of a punch that has the shape of the internal contour of the shell-type of body, is pressed from the top centre through the draw ring gap. In this case, a starting material is always used that is distinctly thick-walled relative to the shell diameter. When forming shell shapes with a small wall thickness-diameter ratio, folds form in the sheet. Bottom pressing therefore does not enable small thin-walled metal components with the correct final contour to be produced. To obtain the required final wall thickness rather requires a reworking by turning or milling.

With convex pressing, a round blank, that is held in the pole or centre of rotation against a rotating, convex-shaped pressure mold is pressed against the pressure mold by means of a forming roller and formed into a shell-type body. The forming always takes place from the centre clamping outwards. By means of the convex pressing, such as for example is described in GB 1,468,659 or EP 1 285 707 B1, relatively thick starting sheets can generally also only be formed into shell-type bodies. The minimum wall thickness required for the forming, in addition to the diameter of the shell to be produced, depends on the shape of the cross section of the shell-type body. When forming shell-type bodies with a small wall thickness-diameter ratio, folds likewise form in the sheet. To reduce the folding and mechanical reworking, devices are recommended according to U.S. Pat. No. 3,355,920 that are designed to enable the mold to be sized.

With concave mating mold pressing, a preformed round shell, that is held in the instaneous centre or centre of rotation against a rotating, concave-shaped pressure mold, is pressed against it by means of a forming roller and is rotationally-symmetric formed from the inside. As, for example, can be seen from U.S. Pat. No. 6,006,569, a shell-type body cannot be brought to its final shape and size in the concave pressure mold. Instead, further steps, particularly an additional forming on a convex curved pressure mold, are necessary.

With shot-blast forming, single, flexibly pre-curved components are formed into the spherically-curved segments of a shell-type body by blasting with small balls and then a pole cap is either welded or riveted to a, mainly large, shell-type body. Although shot-blast forming, as for example disclosed in DE 38 42 064 C2, has been proven in practice, the necessary wall thickness reinforcements of weight-optimized shell-type bodies such as the domes of tanks for aerospace applications in the area of welds and/or riveted joints has proved an obstacle.

With counterroller pressing, a rotating round blank clamped on the edge is formed by an internal roller and a counterroller. This enables materials that are difficult to form to be formed essentially using pressure forces. This is produced by the interaction of the two opposing rollers whereby the rotating shell-type body is stressed and thus formed. The formability of materials is improved by applied pressure stresses. With the counterroller pressing, as for example has been described in EP 0 593 799 B1 and has been proved in practice, the forming takes place exclusively due to pressure stresses that build up between the rollers. This means that undesirable material stresses due to tension are avoided or limited. This results, not least, in certain restrictions for counterroller pressing because the overall design of the device, due to the many individual components required owing to the rollers having to correspond to each other, is very expensive and cost intensive. Furthermore, the programming expense for the NC controller is greater because two rollers have to be controlled.

Finally, with concave pressing, for example described in EP 0 457 358 B1, U.S. Pat. No. 3,316,745, GB 201,269 and U.S. Pat. No. 6,006,569, a rotating circular blank cut to size, e.g., a preformed round blank, is secured along its circumference to a ring or clamping plate, is curved outwards by a roller in a free space behind the ring plate or clamping plate and formed as necessary into a rotationally symmetrical, shell-type body with the correct final contour dimensions. This takes place, depending upon the necessary curving, mostly in several individual steps, with the round material being plastically expanded and tensioned in azimuth in the diaphragm area due to the increase in area. Substantial manufacturing costs of the shell-type body due to the high heat and energy costs on one hand and the high manpower, retoolings and thus time and cost on the other hand have been shown to be a serious disadvantage, particularly with concave pressing.

The object of this invention is therefore to provide a method and a device for forming or deforming an essentially flat metal blank to produce a thin-walled, shell-type body, by means of which the above disadvantages can be avoided, that furthermore enables a much improved economic utilization and, particularly in view of the greatly increasing requirements of aerospace, provides low weight and high strength combined with a high degree of dimensional stability, and use of same.

With regard to the method, the object is achieved in a surprisingly simple manner by the features of claim 1.

By means of the arrangement of the method in accordance with the invention for forming or deforming an essentially flat blank of metal into a thin-walled, shell-type body, with the blank being clamped over its circumference to a supporting structure with a mold chamber in which the blank is held during increasing deformation into the thin-walled, shell body, the reverse face of the blank facing the mold chamber being sealed with respect to the front face of the blank facing away from the mold chamber, a vacuum being applied to the mold chamber closed by the blank and the blank being deformed by a defined evacuation of the mold chamber and by at least one forming tool applied to the front face of the blank to form the thin-walled shell body, with the blank and the at least one forming tool being moved, especially rotated, relative to each other, a method of manufacture is proposed that due to a substantially improved utilization of existing heat and force potentials leads to a high economic efficiency due to the substantial reduction in energy costs and accompanying time saving. At the same time, a significantly large shape and dimensional accuracy of the thin-walled, shell-type body accompanied by weight saving and an increase in strength and load limits are enabled. The application of a vacuum and the defined evacuation of the mold chamber is very significant, with the term "vacuum" in the following being a technical term including a coarse vacuum and generally a negative pressure. The forming and/or deforming or concave pressing with the aid of a negative pressure is thus substantially accelerated. The negative pressure at the same time has the effect of holding the blank clamped due to the pressure difference between the ambient pressure on its front face and the negative pressure on its reverse face and consequently is drawn or lightly pressed into the mold chamber in the direction of the subsequent final geometry into a thin-walled, shell-type body. The negative pressure, in an advantageous manner, compensates for any material shifts that occur due to the different stress conditions within the blank during the deforming or forming or during concave pressing into a thin-walled, shell-type body. By applying a vacuum to the mold chamber closed by the blank and by the defined evacuation of this chamber, further substantial advantages result. Thus, the clamping forces acting on the blank in the supporting structure to be deformed or formed or to be pressed are increased. Thus also, stresses in the blank can be induced that are proportional to the effective pressure difference between the ambient pressure acting on the front of the blank and the negative pressure felt on the reverse of the blank. These stresses substantially support and accelerate, particularly with regard to time, the deforming and/or forming or concave pressing. At the same time, a further problem can be prevented, or at least reduced. Thus if a forming tool is used, any material wave of the blank driven before the forming tool is reduced, because the level of such a wave can be reduced by the influence of the stresses induced in the blank by the vacuum or negative pressure. Last but not least, the evacuation of the mold chamber on one hand and the accompanying accelerating deforming and/or forming or concave pressing of the blank into a thin-walled, shell-type body on the other generally reduces the occurrence of oxidation.

Further advantageous design details of the method in accordance with the invention are described in claims 2 to 18.

In an embodiment of the inventive method, the blank in accordance with claim 2 is warmed and/or heated to an elevated temperature profile by at least one of the devices allocated to the mold chamber.

In an advantageous manner, the blank is furthermore in accordance with claim 3 held at an elevated temperature profile by at least one of the devices allocated to the mold chamber for thermal insulation and/or by at least one of the devices for heat reflection allocated to the mold chamber. Hot forming depends principally on maintaining, within narrow tolerances, the temperature conditions of the blank that have been set or an elevated temperature profile of the blank that has been reached, so that the heat energy requirement, particularly also in the case of thin-walled blanks or shell-type bodies, is kept constant without a great control effort, and particularly kept small. For this purpose, heat losses in the blank or subsequent shell-type body in the mold chamber are reduced in that convection losses can be largely eliminated by extracting the air through the device for a defined evacuation of the mold chamber and pipeline or radiation losses also almost completely eliminated by lining the mold chamber with heat-insulating material and surrounding the mold chamber with reflecting (multiscreen) reflector film.

To avoid, or at least to limit, oxidation to which the blank is exposed due to the application of heat, according to claim 4 of the invention protective gas is applied to the blank through a device arranged in the mold chamber or communicating with the mold chamber.

The measures of claim 5 are particularly significant for a simplified and accelerated production of a thin-walled, shell-type body from an essentially flat blank. According to this, the blank is formed into a thin-walled, shell-type body by means of a perforated mating mold arranged in the mold chamber. The perforated mating mold also serves to hold and support the blank or subsequent thin-walled, shell-type body after the mold chamber has been adequately evacuated.

With blanks with a greater wall thickness or with a more complicated meridian geometry it is particularly advantageous that the method in accordance with the invention for deforming and/or forming or pressing is supported by the use of vacuum using the technical features of claim 6. According to this, the blank is formed into a thin-walled, shell-type body similar or corresponding to the principal of "concave pressing" by at least one forming tool applied to the front of the blank. In this case, at least one forming or pressure roller and/or a pressure ball, that is then advantageously hydrostatically mounted, is used as the forming tool. In doing so, the blank and the at least one forming tool are moved relative to each other, especially rotated.

In this connection, it has been shown to be particularly advantageous to influence the dimensional stability of the blank and subsequent thin-walled, shell-type body during the deforming and/or forming of concave pressing in accordance with the measures of claim 7, in that the forming tool applied to the front of the blank is, in deviation from the previous handling, moved relative to the blank from the circumference to the middle of the blank and/or equally from the middle to the circumference of the blank. By means of such movement, that may be alternating as required, the disturbing influence due to strong elastic recovery of the blank in the area of its pole in particular is better controlled and is reduced early. This method also provides the possibility of creating particularly flat shapes in the pole area of the blank, such as are frequently used in aerospace. Furthermore, distinctly shortened travel paths of the forming tool are achieved by such guidance and, not least, this results in a clear overall time saving. In principle, the special movement of the at least one forming tool can be in the form of a spiral relative to the blank from inside to outside or vice versa from outside to inside, but always consisting purely of great circles or kinematic combinations of same that lead to the required geometry of the thin-walled, shell-type body. A relative movement between the blank and forming tool can also take place in steps with a matched application in each case and in any combinations of the particular basic movements, in order to generate a required geometry.

A further increase in the dimensional stability that can be achieved with the method in accordance with the invention is achieved by the features of claim 8, whereby the forming tool applied to the front of the blank is controlled by closed-loop and/or open-loop control. The final geometry of the thin-walled, shell-type body can thus be defined by the meridian curve of a (plate) template or by programming the meridian curve of the (plate) template into an NC controller. In this way, the feed of the forming tool is determined and limited parallel to the central axis of location of the blank relative to the radius and also takes account of the elastic recovery behavior of the material at the same time. Subsequent changes or adaptations of the geometry for other-shaped, shell-type bodies are possible without a high-expenditure of time, personnel or accompanying costs, with it being necessary merely to change the template or NC controller for the forming tool.

In a further embodiment of the method in accordance with the invention, the blank in accordance with claim 9 is, before deforming into the thin-walled, shell-type body, formed in a quite advantageous manner from at least two separate flat elements that are joined together to form one unit by means of tungsten inert gas (TIG) welding, metal inert gas (MIG) welding, friction stir welding (FSW), electron beam (EB) welding, laser or plasma welding or any other suitable method of welding.

In this connection it is especially significant that the blank in accordance with claim 10 is soft annealed before deforming into a thin-walled, shell-type body. The deforming and/or forming or concave pressing can thus be performed more simply and safely, the softer and more ductile the material behaves. If the blank to be deformed and/or formed or pressed consists of an assembly of several separate surface elements, the soft annealing is advantageous for the removal of internal stresses and differences in the deformation strength due to welding.

Furthermore, the design measures of claim 11 are of particular interest for obtaining the required final wall thickness of the thin-walled, shell-type body. Accordingly, before deforming into the thin-walled, shell-type body, the blank is pre-contoured by chip removal, particularly by turning, milling and/or grinding, i.e. provided with a predetermined wall thickness distribution in the flat condition. Due to the rigid clamping of the blank on the circumference, the material required for changing the shape or increasing the area of the blank is to be obtained by ironing out from the starting thickness. With a predetermined component shape and material properties technically suitable for forming, this leads to a typical meridianal wall thickness distribution, with the wall thickness of the blank at the pole and at the circumference being maintained due to the process. The final wall thickness of the thin-walled, shell-type body can be precisely set by pre-contouring the starting thickness before deforming. If the blank is welded together from several separate flat elements due to its proportions or dimensions, the wall thickness distribution can, moreover, be appropriately chosen in the area of the welds.

The appropriate provision of a contouring of the rear face of the blank in accordance with claim 12 has been shown to be particularly advantageous in practice. This makes sure that the forming tool comes into contact with the uncontoured, smooth front face of the blank, provided such a forming tool is really necessary.

Equally, the blank can, particularly in its pole area, in accordance with the features of claim 13, be provided with openings or similar cutouts by chip removal, particularly by turning, milling and/or grinding, before deforming and/or stretching into the thin-walled, shell-type body. With a shell-type body that is perforated in the pole area before the solution annealing, in order to guarantee a fast, problem-free coolant draining when quenching the shell-type body, the stretching can, aided by vacuum if the openings, perforations or similar cutouts are vacuum-proof sealed before the stretching, be carried out in the cold condition. Covers that provide a temporary vacuum-proof sealing are provided for this purpose. For example, stick-on covers of plastic film are suitable as such covers. To increase the retention of the covers, the openings, perforations or similar cutout are preferably small but proportionally more numerous. In this way, the covers can remain safely attached and supported on the intermediate webs, even under large negative pressures.

The measures in accordance with claims 14 to 17 serve quite advantageously for the further arrangement of the method in accordance with the invention. Particularly if the blank is made of metal, especially from aluminum or a, possibly hardenable, aluminum alloy such as A1 2219 or A1 2195, an optimum heat treatment is usually sought in order to achieve material properties with a condition T8. Starting with a soft-annealed, possibly already pre-contoured or otherwise preformed blank, the blank is clamped in accordance with the inventive method and formed by initial pressing. In this way, depending on the geometry, degrees of local forming of more than 50% with regard to wall thickness reduction and of more than 60% with regard to lengthening in the meridian direction can be realized. The blank, at least the first semifinished, thin-walled, shell-type body, is unclamped and subjected to intermediate heat treatment. Such intermediate heat treatment includes solution annealing and quenching. The blank, at least the first semifinished, thin-walled, shell-type body, is then clamped again and finally shaped by uniform stretching. An additional tool is not necessary. Furthermore, the deforming and/or forming or concave pressing is defined by the control of the final vacuum and/or of the forming tool. After stretching, a hot age-hardening in an oven takes place in order to achieve the T8 condition. The T8 condition is at present the maximum achievable condition for hardenable aluminum alloys frequently used for rocket fuel tanks.

Finally, to further increase the achievable dimensional stability, it is provided in accordance with the invention that the blank in accordance with claim 18 is continuously measured when forming into the thin-walled, shell-type body. Such a geometric measurement of the blank can, for example, be carried out automatically, perhaps using a contactless measuring system that can be swung into place. The vacuum and/or the movement of the forming tool can be automatically adjusted by a closed-loop and/or open-loop control system, in order to compensate for deviations from the required shape of the blank. Dimensional deviations, such as out-of-round, are compensated for or eliminated in this way. The dimensional accuracy of the final produced thin-walled, shell-type body is substantially increased. At the same time rotational symmetry material properties as well as material properties that are not rotationally symmetric can be corrected.

The object is further achieved with regard to the technical device in a surprisingly simple manner by the features of claim 19.

By means of the embodiment of the device in accordance with the invention for forming or deforming an essentially flat blank of metal into a thin-walled, shell-type body, that includes a supporting structure forming a mold chamber, that holds the blank for its increasing deformation in a thin-walled, shell-type body, includes a device for clamping the blank around its circumference to the supporting structure that seals the rear face of the blank facing towards the mold chamber with respect to the front face of the blank facing away from the mold chamber, and a device allocated to and communicating with the mold chamber for applying a vacuum and evacuating the mold chamber, and at least one forming tool applied to the front face of the blank is/are allocated to the supporting structure, a structure that is overall particularly simple whilst at the same time compact and stable is achieved. Furthermore, with the device in accordance with the invention, the applied heat and force potentials can be substantially better utilized compared with prior art. Not least, this results in overall substantially reduced energy, and thus manufacturing costs for the particular thin-walled, shell-type body. Of particular significance are the device for providing a sealing clamping of the blank on one hand and the device allocated to and communicating with the mold chamber on the other for applying a vacuum and evacuating the mold chamber itself. In this way, the deforming and/or forming or concave pressing of the blank into a thin-walled, shell-type body can be aided by a negative pressure and significantly accelerated. The time saving that can be achieved is substantial. Not least, the device in accordance with the invention enables a high degree of cost effectiveness to be achieved. At the same time, the device in accordance with the invention enables a particularly high degree of dimensional stability to be obtained for the parts to be formed from the blank into a thin-walled, shell-type of body. By using a vacuum chamber, it is furthermore possible to increase the clamping forces acting on the blank and to reduce the convective heat losses when heat is used. Furthermore, the negative pressure assists the deforming and/or forming or concave pressing during the possible use of an additional forming tool. An area of the material possibly not yet formed is drawn in the direction of the new mold of the thin-walled, shell-type body by the negative pressure, with it being possible at the same time to reduce any wave that forms in front of the forming tool. Any variations in stress conditions within the blank during its deforming and/or forming or concave pressing into a thin-walled, shell-type body are advantageously compensated for by the negative pressure. In this way, it is possible to enlarge the individual steps for deforming and/or forming or concave pressing and/or to increase the degree of forming for individual steps and thus to reduce the overall number of work steps required. With forming assisted by vacuum, the drive power required for the forming tool is reduced where at least one forming tool is used with the other conditions remaining the same, thus resulting in a reduction in the production and operating costs. There is also a further aspect of particular significance, i.e. the oxidation of materials due to the application of vacuum or evacuation of the mold chamber during deforming and/or forming or concave pressing can be prevented or at least reduced. Subsequent cleaning of the surface is correspondingly reduced. This in turn very substantially reduces the time required.

Further advantageous design details of the device in accordance with the invention are described in claims 20 to 50.

Accordingly, it is possibly as part of the invention to form the supporting structure for forming the mold chamber in accordance with claim 20 essentially as a cup, pot, dish, cone, truncated cone shape or similar hollow shape.

The features of claim 21 are of particularly great significance for a simple, effective and efficient construction. According to this, the supporting structure of the device in accordance with the invention has at least one device for irradiating the mold chamber for warming and/or heating the blank, that in particular is designed as an electrically operated light lamp heater, infrared radiation heater, induction heater or circulation-type heater with a circulating heat carrier, preferably water, oil, molten salt or sodium. The warming and/or heating of the blank takes place in this manner by the actual device in accordance with the invention and not, as is the case with prior art, from outside, although other external heat sources could be used. This is very advantageous in that not only is the total energy requirement of the thin-walled, shell-type body to be produced effectively minimized but also the time required for warming and/heating can be reduced. If radiation sources are used, it is useful if these are distributed over the complete surface in order to achieve a largely uniform distribution of the temperature over the blank and subsequent shell-type body. A reduced radiator temperature and/or an adequate distance between the radiator and blank itself help(s) to prevent isolated temperature increases, hot spots, on the shell-type body. Electrically heated resistors or electrically heated surface radiators filled with a suitable heat carrier can, for example, be used as radiators. Alternatively, an induction heater can be used for ferromagnetic materials. Suitable optimization enables not only the heat requirement but particularly also the machine utilization time to be reduced.

The measures of claims 22 to 24 also provide a further saving in heat and energy, and thus associated costs, combined with an additional improvement in the efficiency and cost effectiveness of the device in accordance with the invention. Accordingly, the supporting structure has at least one device allocated to the mold chamber for thermal insulation and/or at least one device allocated to the mold chamber for heat reflection, particularly a reflecting (multiscreen) reflector film, and/or a device for active cooling 134. This enables the heat and energy applied to the blank, and the subsequent shell-type body, to be optimized and at the same time protects the supporting structure of the device in accordance with the invention against high thermal stresses.

To prevent, or at least limit, the oxidation of the surface of the blank, preferably a device for applying protective gas to the blank is allocated to the supporting structure in accordance with claim 25, that in particular is arranged in the mold chamber or communicates with the mold chamber for supply of same.

To improve the monitoring of the deformation and/or formation or pressing operation, a device for monitoring the temperature of the mold chamber and/or the blank at points and/or over the complete area, is allocated to the supporting structure and/or the blank in accordance with claim 26, for example in the form of thermocouples, and, additionally or as an alternative, a thermal imaging camera. In this way, anomalies can be more quickly detected and then dealt with before damage can occur to the blank or shell-type body.

Advantageously, the device for clamping the blank in accordance with claim 27 has a pressure ring and clamping ring with a sealing ring between the pressure ring and clamping ring, by means of which complete sealing of the rear face of the blank facing towards the mold chamber with respect to the front face of the blank facing away from the mold chamber is ensured.

Furthermore, it is provided in accordance with the invention that the supporting structure in accordance with claim 28 is fitted with a device for reducing the radial heat expansion between the blank and the device for clamping the blank.

In this connection, the device for clamping the blank in accordance with claim 29 can be shifted radially and/or circumferentially with respect to the supporting structure or can otherwise be flexibly arranged. In any case, part of the impermissible thermal distortion in the blank or finished shell-type body in the form of stresses can be accommodated by elastic recovery. Consequently, relative movements of the blank or shell-type body during the warming or heating are enabled.

Furthermore, it is within the scope of the invention that a perforated mating mold arranged in the mold chamber is allocated to the supporting structure of the device in accordance with the invention according to claim 30 that is provided to hold and support the blank to be formed into the thin-walled, shell-type body.

In an alternative or additional embodiment, it is provided in accordance with the invention corresponding to claim 31 that at least one forming tool applied to the front face of the blank is allocated to the supporting structure. This forming tool can consist of one or more forming or pressure roller(s) and/or pressure ball(s). Advantageously, such pressure ball(s) is/are preferably hydrostatically mounted. An advantage of a pressure ball compared with a pressure roller is its simple construction and overall handling, and with a pressure ball, the complete structural expenditure for the articulation of the pressure roller, e.g., a servodrive for tracking the angle of inclination, etc., is omitted. In every case, the production time for a shell-type body from an essentially flat blank by using at least one additional forming tool is substantially reduced. Particularly where several forming tools are used simultaneously and synchronously, for example where there are also two differently set, i.e. offset radially and in azimuth, forming tools, this can have a considerable influence on the production time of a shell-type body.

The at least one forming tool applied to the front face of the blank is, according to the features of claim 32, template- or numerically-controlled using open-loop and/or closed-loop control.

Furthermore, it is within the framework of the invention that the at least one forming tool that is applied to the front face of the blank can be individually set with regard to its application in accordance with claim 33.

It has been shown to be completely appropriate that the at least one forming tool applied to the front face of the blank in accordance with claim 34 is supported by a traverse that is allocated to the supporting structure, with the supporting structure together with the blank and traverse being moveable, especially rotatable, relative to each other.

In a case of deforming and/or forming or the concave pressing of the blank into a thin-walled, shell-type body with the aid of at least one forming tool, it is particularly advantageous if the supporting structure and the at least one forming tool can be rotated relative to each other in accordance with claim 35.

Of particular interest in this case are the features of claim 36, according to which the supporting structure together with the blank clamped to it are designed to be rotatable and the at least one forming tool can move in two dimensions only along a fixed meridian.

In this connection, it is within the framework of the invention in accordance with claim 37 that the supporting structure together with the blank can be rotated by a drive device about a central axis of rotation of the supporting structure, while the at least one forming tool can be moved two-dimensionally on a specially fixed meridian curve by means of two servodrive devices. The at least one forming tool thus does not move on a circle or spiral tracks but instead only on a spatially-fixed meridian curve. It is guided in two dimensions by a (plate) template or an NC controller. A spatial spiral movement relative to the blank results from the superimposition of the rotation of the supporting structure together with the blank and the movement of the forming tool.

In an alternative embodiment of the invention in accordance with claim 38, the supporting structure together with the blank can be of fixed construction and the at least one forming tool can be designed to rotate. Such an embodiment of the device in accordance with the invention is advantageous if the blank, or subsequent thin-walled, shell-type body, has large dimensions, particularly a large diameter.

According to the measures of claim 39, the at least one forming tool in this case is appropriately arranged in a traverse that extends diametrically over the supporting structure together with the blank and is guided in a rail arrangement or similar, can be rotated about a central axis of rotation by the drive device of the traverse and can be moved on a meridian curve relative to the traverse by means of two servodrive devices. In this way, the usually heavy supporting structure together with the blank is not rotated about a central axis of rotation by means of a drive device, but instead the traverse with the at least one forming tool complete with a roller guide is rotated. The roller guide and the necessary servodrive devices are arranged on the traverse that extends diametrically over the traverse with a clearance from the blank. The traverse is guided on both sides by a rail arrangement, for example in rails or similar, and circles over the blank during deforming and/or forming or concave pressing with at least one forming tool. To avoid the traverse lifting out of the rail arrangement, a special prism guide is provided. The forming tool again moves relative to the traverse on a meridian curve, i.e. in two dimensions. Accordingly, there are two templates or NC-controlled servodrive devices in each case for each forming tool for the vertical or radial movement or deflection. For reasons of stability, the traverse can also have a sufficiently wide supporting surface, if necessary using two transverse supports or similar, in order, for example, to cope with emergency stops at high rotational speeds without the large transverse forces acting on the rail arrangement of the traverse.

In a useful manner, the central axis of rotation of the supporting structure or of the traverse in accordance with claim 40 is arranged horizontally or vertically. The choice depends mainly on the design conditions, such as for example the drives, etc., that can be used. The larger the dimensions of the blank and shell-type body, the more devices with a vertical axis of rotation are preferred.

Of particularly great importance for an unhindered clamping of the blank in the device in accordance with the invention or the unclamping of the shell-type body from the device in accordance with the invention are the design measures of claims 41 to 46. In this way, free access to the supporting structure of the device in accordance with the invention is guaranteed in each case.

Accordingly, the traverse for replacing a blank with a thin-walled, shell-type body and vice versa, can in accordance with claim 41 be detached from the circulating supports or a circulating rail ring or rails or similar and lifted off by means of a hoist, for example in the form of a works crane, in order for it to be able to be placed to the side of the device in accordance with the invention for the next loading or unloading.

As an alternative to this, it can also be provided in accordance with the invention for the traverse for replacing a blank by a thin-walled, shell-type body and vice versa, to be designed in accordance with claim 42 so that it can be moved by means of rail switches on two straight parallel rails, that are tangentially connected to a rail ring. In this way, it is possible for loading and subsequent unloading to bring the traverse to a temporary parked position next to the device in accordance with the invention.

Furthermore, it is possible for replacing a blank by a thin-walled, shell-type body and vice versa, for the traverse to be designed to be hydraulically lowered and moved sideways in accordance with claim 43. The device in accordance with the invention can again be temporarily brought to a side parked position for loading and unloading.

In a further alternative proposal for replacing a blank by a thin-walled, shell-type body and vice versa, the traverse in accordance with claim 44 can be moved out of, or into, an opening in the rail supporting structure underneath a rail or similar supporting carrier ring. The carrier ring for the rails or similar is therefore located above the device for clamping the blank, so that the supporting structure can be moved in and out through the opening in the rail supporting structure. The traverse thus remains stationery in the rails or similar. The replacement of the blank or shell-type body takes place outside the rail supporting structure. For deforming and/or forming or concave pressing, the supporting structure complete with the blank is moved back to the centre of the rail supporting structure, centrally aligned and locked and connected to the vacuum connection and to other supply connections for electric power and electric signals.

In accordance with a further embodiment in accordance with the invention, the traverse in accordance with claim 45 is moved linearly backwards and forwards on two straight parallel rails or similar above the fixed supporting structure and carries the at least one forming tool so that it can be moved backwards and forwards along the traverse in such as way that the at least one forming tool can be applied to the blank in circles or spiral tracks with a constant angle of inclination and at defined height positions. The traverse can thus be moved linearly backwards and forwards along two straight rails or similar parallel to each other above the supporting structure in a standard gantry design. The at least one forming tool is arranged on the traverse and moved in a lengthwise direction to the traverse in such a way that the forming tool describes a circle on the blank or the thin-walled, shell-type body being formed, the plane of which extends vertically relative to the central axis of rotation. The servodrive device required for this must operate synchronously with the drive device of the traverse, in order to be able to perform the particular sign or cosign curves precisely. Further servodrive devices are provided for setting the height position or the pressure depth and for the inclination or articulation of the forming tool relative to the central axis of rotation.

Equally, a kinematic reversal of same is conceivable whereby the supporting structure in accordance with claim 46 is moved linearly backwards and forwards on two straight parallel rails or similar under the fixed supporting structure and the traverse carries the at least one forming tool that can be moved backwards and forwards lengthwise along the traverse in such a way that the at least one forming tool is applied to the blank in circles or spiral tracks with a constant angle of inclination and in defined height positions. The supporting structure therefore forms a backwards and forwards movement in a linear slide guide, while the gantry-shaped traverse is fixed.

Furthermore, the device in accordance with the invention is characterized by the features of claim 47. According to this, the supporting structure includes a thermally insulated cover or similar covering plate especially provided with heating surfaces, for covering the face of the blank facing away from the mold chamber. By means of the covering element or similar cover plate 132, the, usually cold, blank to be deformed can be kept covered until its temperature reaches the working temperature due to the application of heat. In particular when bringing the device in accordance with the invention up to working temperature, the substantial heat losses of the blank and associated overall machine occupancy time can be reduced. The cover or similar covering plate 132 makes it easy to vary the heating but also ensures a reduction in the heat losses and oxidation.

An additional advantage are the measures of claim 48, whereby the supporting structure is provided with at least one safety device 136 allocated to the mold chamber to protect against external influences by gaseous and/or liquid coolants, in particular inert gas, preferably argon, nitrogen or water. To quench the blank or thin-walled, shell-type body, inert gas, e.g.: argon or nitrogen, but also water, is used as a coolant. To protect against possible damaging effects of the coolant, the supporting structure and in particular its other components such as devices for warming and/or heating the blank, devices for thermal insulation, devices for heat reflection, the vacuum connection or supply connections for electrical power and electrical signals are installed in such a way that they are safely protected. In this way, it is possible to leave the blank in the device in accordance with invention for further machining. Additional manpower, time and cost-intensive retooling can thus be spared.

In accordance with the features of claim 49, the supporting structure in this connection preferably has at least one device for cooling 134, particularly quenching, the blank and/or the thin-walled, shell-type body via the reverse face facing towards the mold chamber and/or the front face facing away from the mold chamber of the blank or thin-walled, shell-type body, and also including all the necessary supply and return lines for the coolant itself. It is thus possible to quench the shell-type body from both faces, i.e. from its reverse and/or front face.

The device for applying a vacuum and evacuating the mold chamber in accordance with claim 50 appropriately includes a vacuum connection that extends into and through the axis of rotation of the supporting structure and/or communicates with the mold chamber.

Finally, it is also part of the invention that the method in accordance with the invention and/or the device in accordance with the invention corresponding to claim 51 is/are used to produce shell-shaped components that are rotationally symmetrical and/or that are not rotationally symmetrical. Hemispherical, spherical-flat shaped, dome-shaped, ellipsoidal-dome shaped, conical or elliptical components or components that are Casini-shaped or with other cross-section shapes have been shown to be particularly advantageous for this purpose.

The method in accordance with the invention and/or the device in accordance with the invention corresponding to claim 52 is/are quite particularly suitable for the production of shells as domes for rocket fuel tanks, satellite tanks, parabolic antennas, parabolic reflector dishes, parabolic solar collectors, searchlight housings, tank ends, tower cupolas, pressure domes or similar.

Furthermore, it has been shown to be very advantageous in practice to use the method in accordance with the invention or the device in accordance with the invention corresponding to claim 53 for rolling, particularly compaction rolling, of defined surfaces of the thin-walled, shell-type body. This enables material properties such as density, hardness, surface appearance, etc., to be improved at the same time.

Further features, advantages and details of the invention are given in the following description of preferred forms of embodiment of the invention and with the aid of drawings. The drawings are as follows:

FIG. 1 A first form of embodiment of a device in accordance with the invention for deforming an essentially flat blank into a thin-walled, shell-type body.

Figure 2:
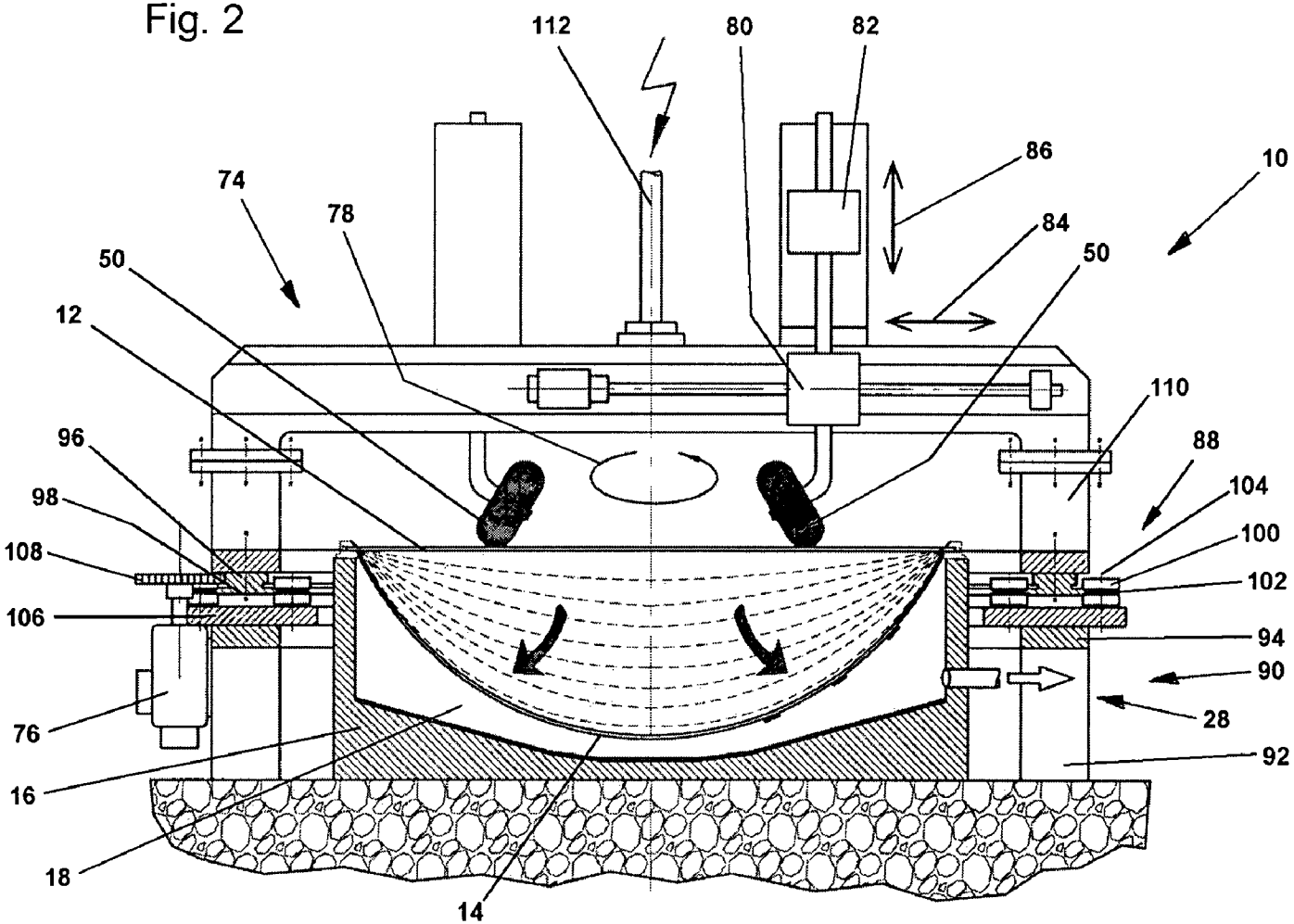

FIG. 2 A further form of embodiment of a device in accordance with invention for deforming an essentially flat blank into a thin-walled, shell-type body.

Figure 3:
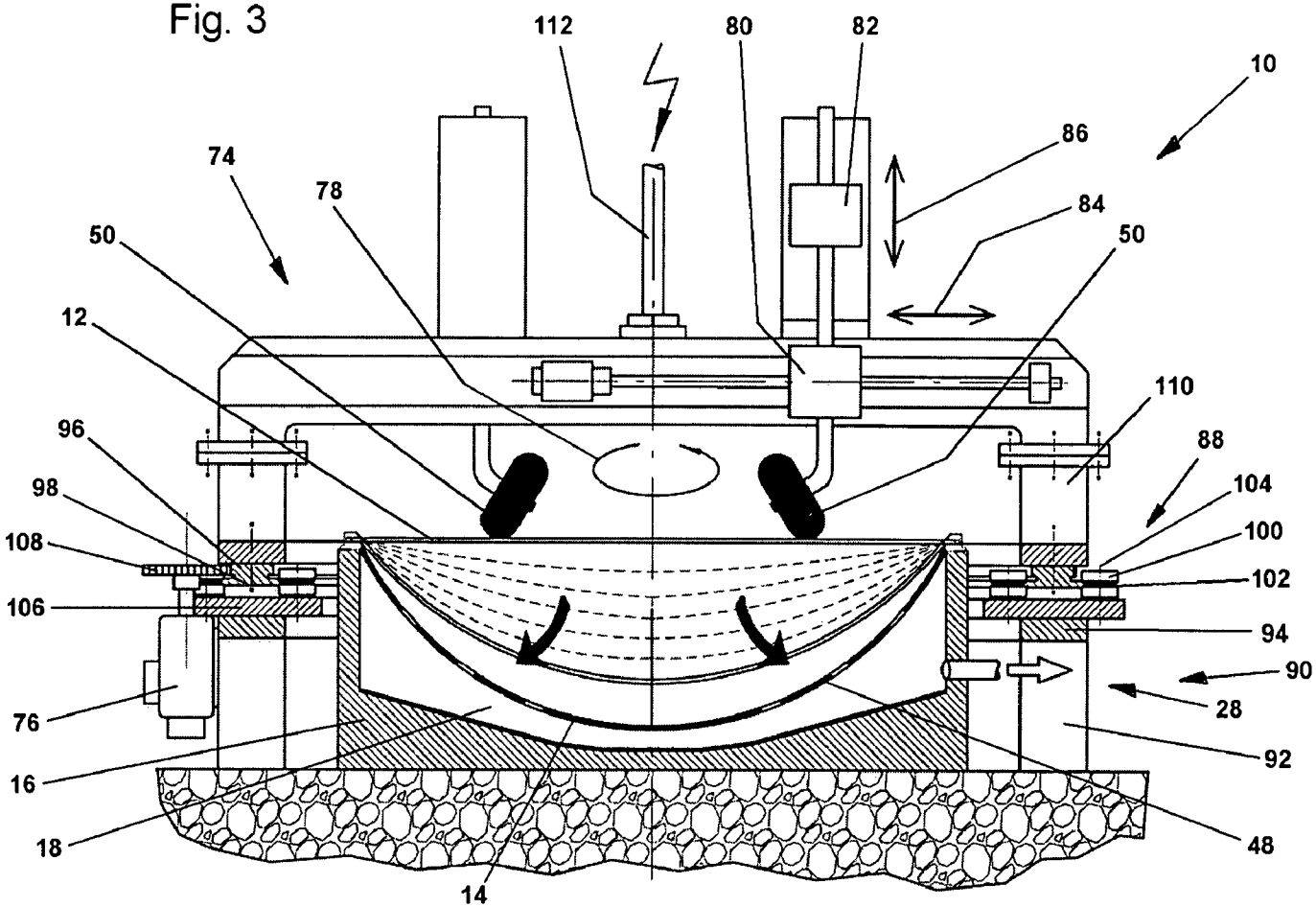

FIG. 3 Another form of embodiment of a device in accordance with the invention for deforming an essentially flat blank into a thin-walled, shell-type body.

Figure 4:
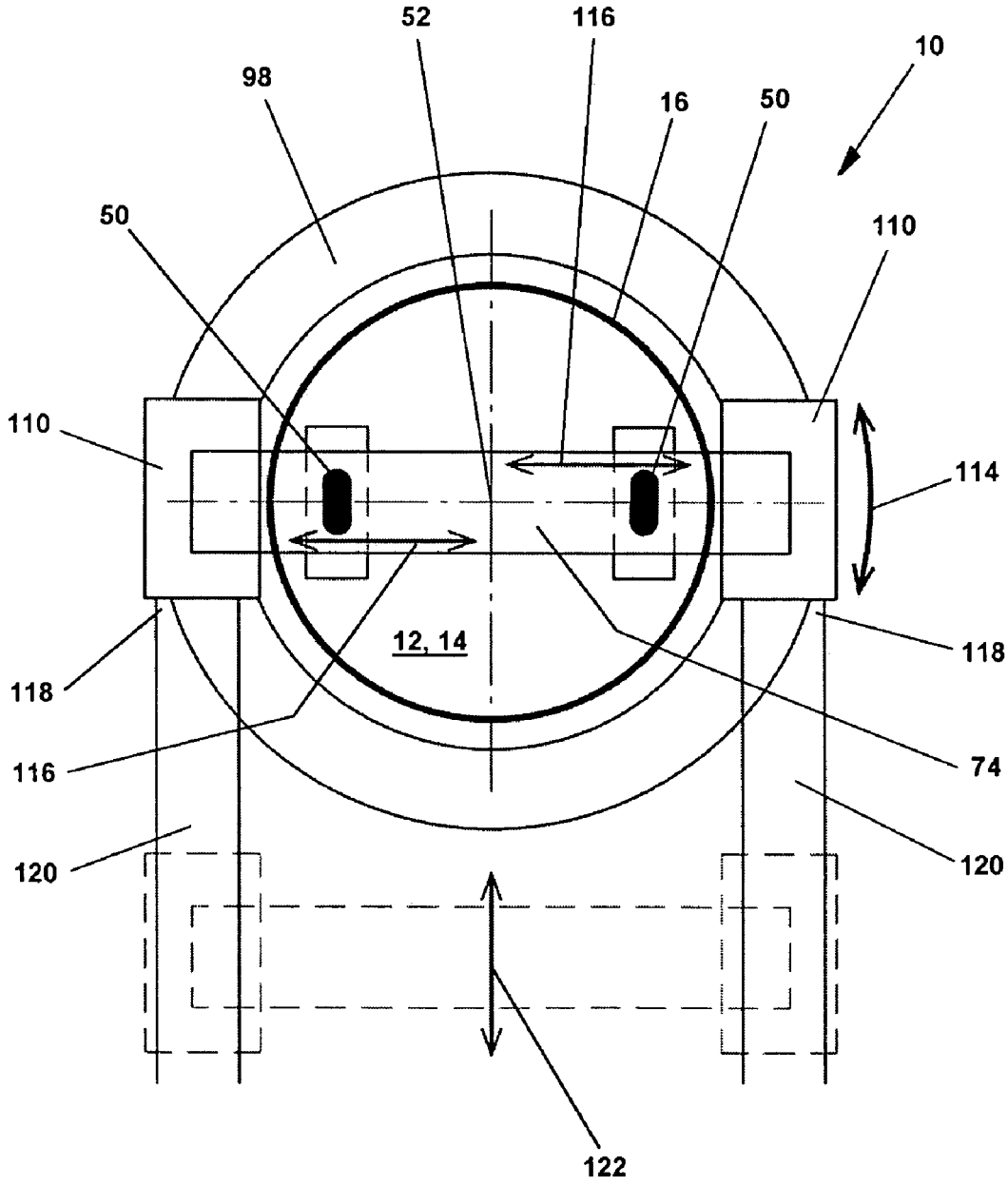

FIG. 4 A schematic plan view of a further form of embodiment of a device in accordance with the invention for deforming an essentially flat blank into a thin-walled, shell-type body.

Figure 5:
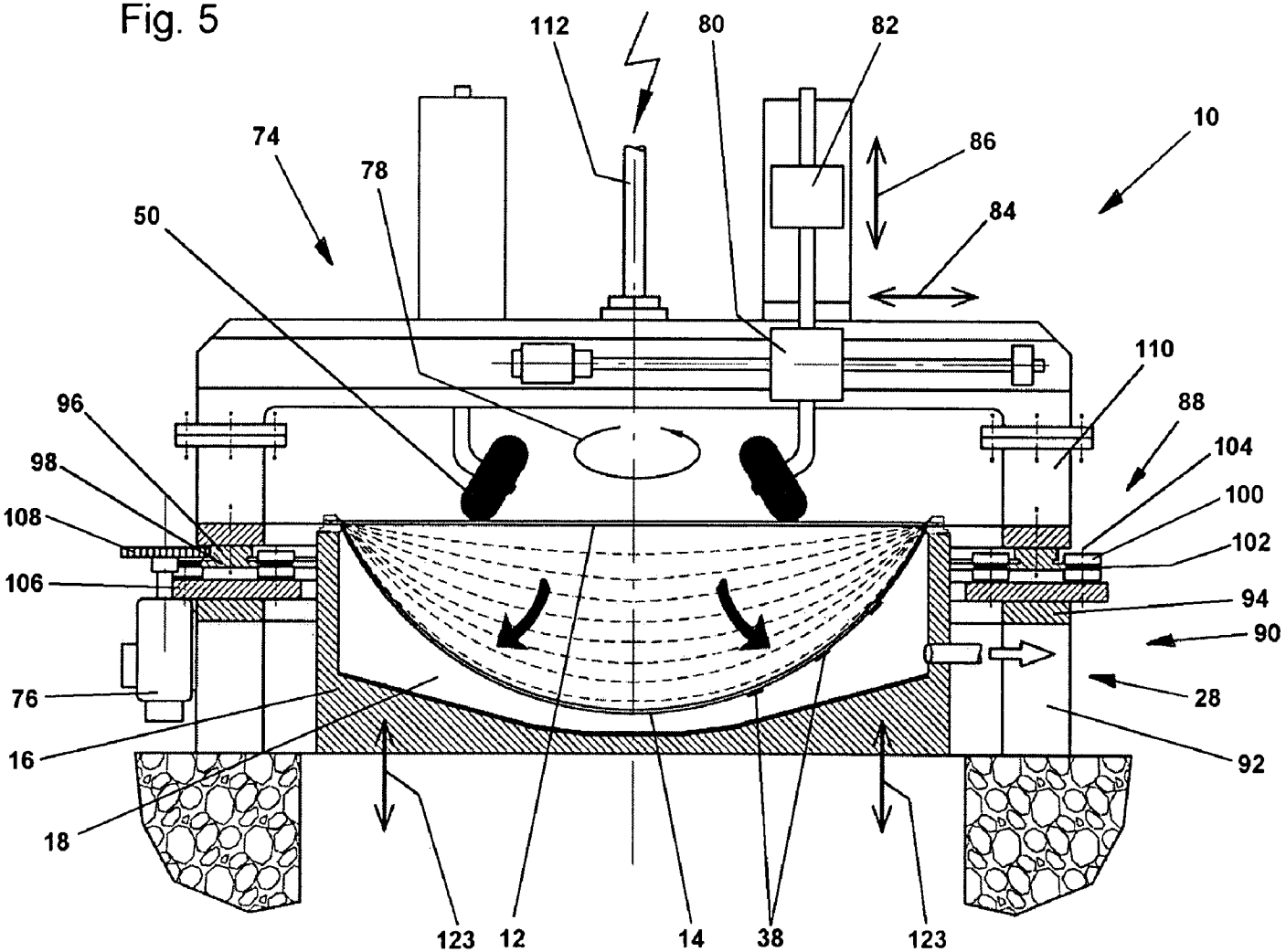

FIG. 5 A modified form of embodiment of a device in accordance with the invention for deforming an essentially flat blank into a thin-walled, shell-type body.

Figure 6:
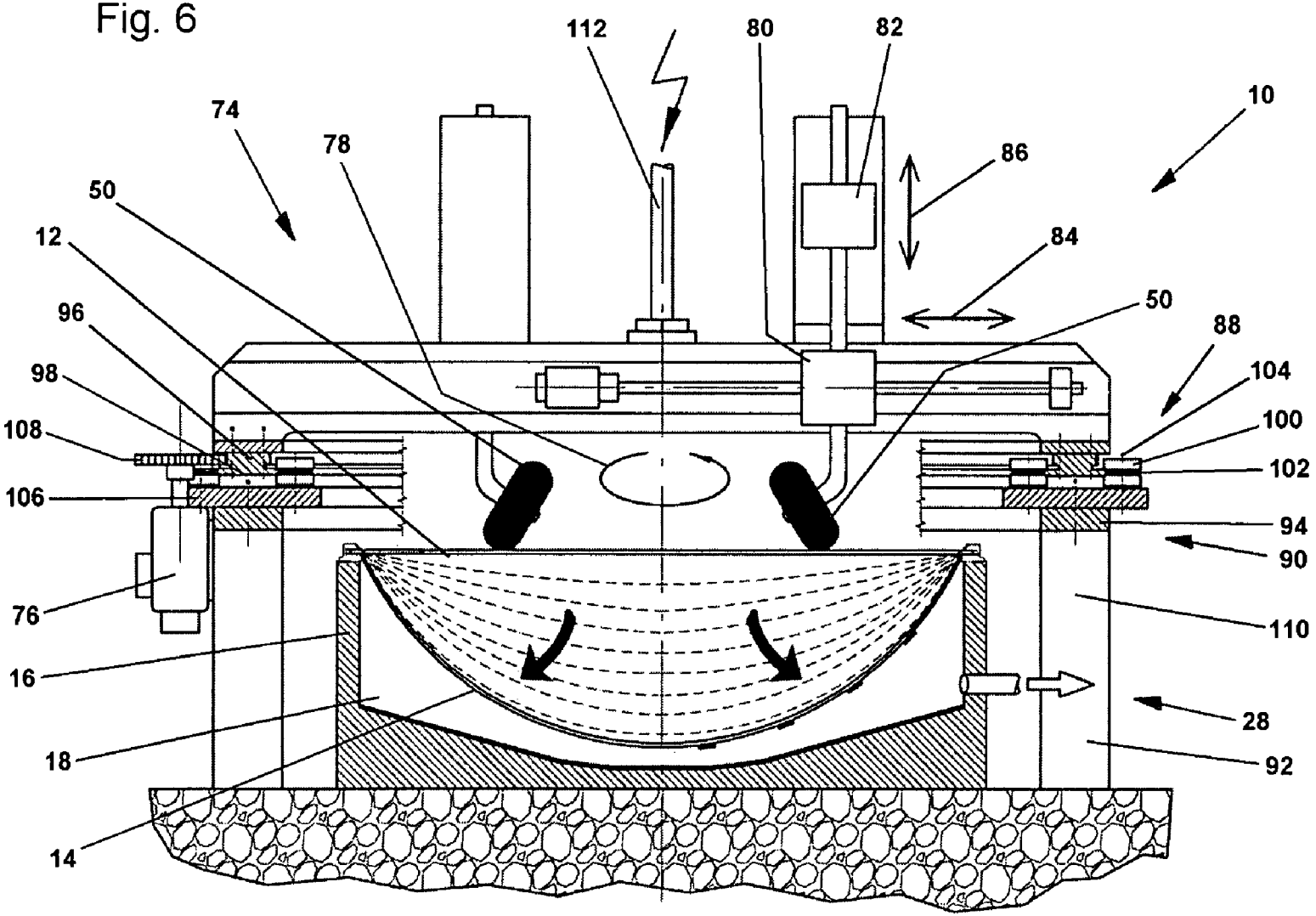

FIG. 6 A further modified form of embodiment of a device in accordance with the invention for deforming an essentially flat blank into a thin-walled, shell-type body.

Figure 7:
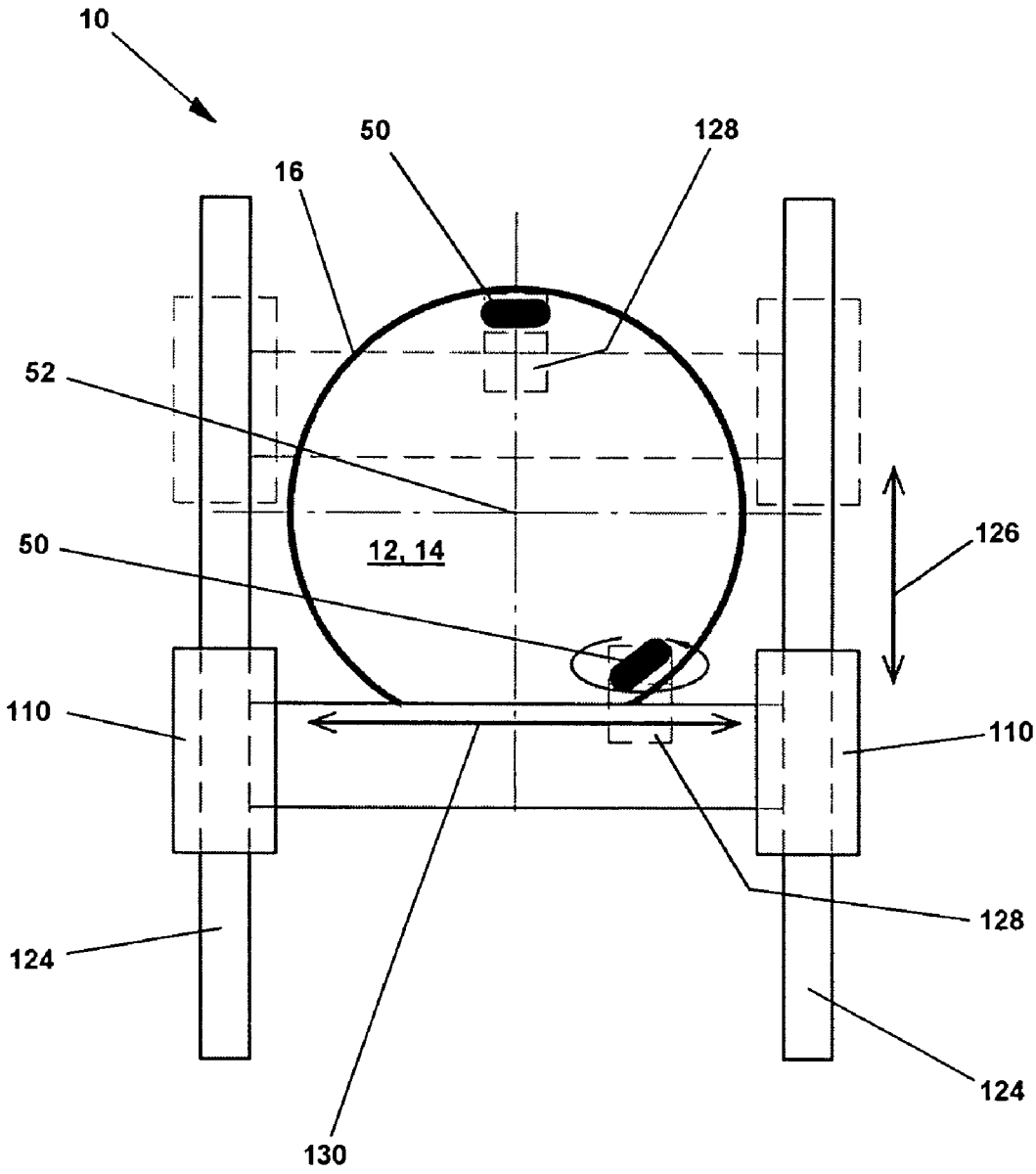

FIG. 7 A schematic plan view of a further different form of embodiment of a device in accordance with the invention for deforming an essentially flat blank into a thin-walled, shell-type body.

The device 10 in accordance with the invention and/or the method in accordance with the invention is/are provided for forming or deforming an essentially flat blank 12 or an essentially flat round blank of metal, particularly of aluminum or a, preferably hardenable, aluminum alloy such as Al 2219 or Al 2195 into a (thin-walled) shell-type body 14, shell-shaped component or similar formed part, and regardless of whether in a hot or cold condition. In the following description of various examples of embodiment of the device 10 in accordance with the invention, corresponding components that are the same are provided with identical reference designators.

The device 10 and/or the method in accordance with the invention is/are suitable especially for producing shell-shaped components that are rotationally symmetrical and/or not rotationally symmetrical. In a clearly advantageous manner, the device 10 and/or the method in accordance with the invention is/are used for the production of hemispherical, spherical-cap shaped, dome shaped, ellipsoidal-dome shaped, conical and elliptical components or Casini-shaped components or components with other shapes of cross-section.

In a quite advantageous manner, the device 10 in accordance with the invention and/or the method in accordance with the invention is/are suitable for the production of shells as domes for rocket fuel tanks, satellite tanks, parabolic antennas, parabolic reflector dishes, parabolic solar collectors, searchlight housings, tank ends, tower cupolas, pressure domes or similar.

Furthermore, the practical use of the device 10 in accordance with the invention and/or the method in accordance with invention for rolling, particularly compaction rolling of defined surfaces of a, including finished, (thin-walled) shell-type body 14 has proved particularly useful.

FIG. 1 shows a first form of embodiment of such a device 10 in accordance with the invention or similar spinning lathe for forming or deforming an essentially flat blank 12 of metal into a thin-walled, shell-type body 14.

The device 10 has a supporting structure 16 that forms or encloses, i.e. encloses or limits, a mold chamber 18. The supporting structure 16 holds the blank 12 during increasing deformation into a thin-walled, shell-type body 14. To form the mold chamber 18, the supporting structure 16 is essentially cup-shaped, pot-shaped, dish-shaped, cone-shaped, truncated cone-shaped or a similar hollow shape. The supporting structure 16 preferably consists of materials that are adequately temperature resistant.

Furthermore, the device 10 in accordance with the invention includes a device 20 for clamping the blank 12 around its circumference 22 to the supporting structure 16. The device 20 for clamping the blank 12 is in this case arranged on the supporting structure 16 or held by it. The device 20 for clamping the blank 12 seals the reverse face 24 of the blank 12 facing towards the mold chamber 18 against the front face 26 of the blank 12 facing away from the mold chamber 18. The interior of the mold chamber 18 is thus insulated from the environment.

Finally, the device 10 in accordance with the invention has a device 28 for applying a vacuum and evacuating the mold chamber 18. The device 28 for applying the vacuum and evacuating the mold chamber 18 is allocated to the mold chamber 18 and is in connection with same, in order to communicate with same.

The supporting structure 16 of the form of embodiment of the device 10 shown in FIG. 1 has at least one device 30, especially one that can be variably controlled, for warming and/or heating the blank 12, that radiates to or into the mold chamber 18. The device 30 for warming and/or heating the blank 12 can be designed as an electrically operated light lamp heater, internal or external infrared radiation heater, induction heater or circulation-type heater with a circulating heat carrier, such as water, oil, molten salt or sodium. Any other forms of embodiment of the device 30 as heat sources for warming and/or heating the blank 12 are equally conceivable. Furthermore, other heat sources or devices 31 for warming and/or heating the blank 12 that are, for example, arranged outside the mold chamber 18 are also possible.

As can be seen from FIG. 1, the supporting structure 16 of the device 10 in accordance with the invention is further fitted with at least one device 32 for thermal insulation. The device 32 for thermal insulation is fitted to the inside of the supporting structure 16 and thus allocated to the mold chamber 18. The device 32 for thermal insulation can be a thermal insulating layer, for example on a glass fiber or ceramic base.

Alternatively or in addition, the supporting structure 16 of the device 10 in accordance with the invention, as shown in FIG. 1, also has at least one device 34 for heat reflection. The device 34 for heat reflection is attached to the inside of the supporting structure 16 and is thus also allocated to, or facing, the mold chamber 18. The device 34 for thermal reflection can, for example, be a reflecting (multiscreen) reflector film.

Without being shown in detail, the supporting structure 16 of the device 10 in accordance with the invention can additionally be provided with a device for active cooling 134. For example, the device for active cooling 134 can consist of an internal cooling system with for example water or oil as the coolant.

The device 32 for thermal insulation and/or the device 34 for heat reflection assist the establishment and maintenance of an elevated temperature profile in the inside of the mold chamber 18 and thus the warming and/or heating of the blank 12 at the same time. The device 32 for thermal insulation and the device 34 for heat reflection also serve to provide thermal protection, if appropriate, to the supporting structure 16 itself, in conjunction with the device for active cooling 134.

As shown schematically in FIG. 1, a device 36 for monitoring the temperature of the mold chamber 18 and/or of the blank 12 is allocated to the supporting structure 16 of the device 10 in accordance with the invention and/or the blank 12. The device 36 for monitoring the temperature can in this case include thermocouples 38 fitted to the reverse face 24 of the blank 12 and, in addition or as an alternative, a thermal imaging camera 40 facing the front face 26 of the blank 12. In this respect, a point and/or area-wide temperature monitoring is provided.

For detachable fixing of the blank 12 to the supporting structure 16, the device 20 is provided with a pressure ring 42 and clamping ring 44 for clamping the blank 12 as shown in FIG. 1. The clamping ring 44 can, for example, be secured by means of bolts (not shown) to the pressure ring 42 with the blank 12 arranged in between. To completely seal the mold chamber 18 against the environment by the blank 12 at the same time, the device 20 additionally has a sealing ring 46 for clamping the blank 12. The sealing ring 46 is positioned between the pressure ring 42 and clamping ring 44. The sealing ring 46 can, for example, be an O-ring. It is also equally conceivable that the sealing ring 46 is a rubber-type profile with a U-shaped cross-section, that is placed on the circumference 22 of the blank 12 before clamping the clamping ring 44 to the pressure ring 42. Other constructive designs that completely seal the mold chamber 18 against the environment by means of the blank 12 are, without being shown in detail, equally conceivable.

When deforming and/or forming or concave pressing of the essentially flat blank 12 into a thin-walled, shell-type body 14, thermal distortion due to the temperature application can occur in the area of the device 20 for clamping the blank 12, due to unequal expansion of the clamped blank 12 and supporting structure 16. An impermissible thermal distortion of this kind can be counteracted in that the supporting structure 16 is fitted with a device for reducing radial and/or circumferential thermal expansion 47 between the blank 12 and the device 20 for clamping the blank 12 (not illustrated). Thus for example, the device 20 for clamping the blank 12 can be designed so as to be displaceable radially and/or circumferentially relative to the supporting structure 16 (also not illustrated). Equally conceivable is a design of the supporting structure 16 that ensures adequate flexibility of the supporting structure 16 when subjected to radially- and/or circumferentially-acting stresses, without impairing the deformation strength of the supporting structure 16 when subjected to (negative) pressure, especially in the area of the device 20 for clamping the blank 12. The stress conditions themselves within the blank 12 due to effects of (negative) pressure can also be advantageously compensated for.

The deforming and/or forming or concave pressing of the essentially flat blank 12 into a thin-walled, shell-type body 14 with the device 10 in accordance with the invention is based solely on the application of (negative) pressure and temperature to the blank 12. The blank 12 is thus mainly automatically brought from an essentially flat shape to a rotationally symmetrical or non rotationally symmetrical (hollow) shape by the effect of external pressure and temperature.

Optionally, in the form of embodiment of the device 10 in accordance with the invention shown in FIG. 1, a perforated mating mold 48, comparable to the form of embodiment of the device 10 shown in FIG. 3, can be allocated to the supporting structure 16. The perforated mating mold 48 is arranged in the mold chamber 18 and is used to hold and support the blank 12 to be deformed into the thin-walled, shell-type body 14. Therefore, the perforated mating mold 48 is partly used as a template for the final shape of the thin-walled, shell-type body 14 to be achieved. The perforated mating mold 48 thus serves to precisely define the final shape to be achieved of the thin-walled, shell-type body 14. The perforations in the mating mold 48 are necessary in order to be able to apply the vacuum to the mold chamber 18 and then to be able to evacuate the mold chamber 18. As shown in FIG. 1, the clear space bounded by the perforated mating mold 48, that is finally completely filled by the thin-walled, shell-type body 14, is smaller than the mold chamber 18 itself and is therefore not identical to the mold chamber 18.

In an alternative or additional embodiment of the device 10 in accordance with the invention, at least one forming tool 50 is furthermore allocated to the supporting structure 16, that comes into contact with the front face 26 of the blank 12 and is thus applied to the front face 26 of the blank 12. The forming tool 50 is used to support the deforming and/or forming or concave pressing by the device 10. Only one such forming tool 50 is provided for the form of embodiment of the device 10 shown in FIG. 1. Here, the forming tool 50 is designed as a forming or pressure roller. Without being shown in detail, the forming tool 50 can, however, also be designed as a pressure ball that is preferably hydrostatically mounted, by means of which the tracking of the angle of inclination of a forming or pressure roller, necessary in many cases, can be avoided.

In an advantageous manner, the at least one forming tool 50 that is applied to the front face 26 of the blank 12 is controlled using a template or numerically using closed-loop and/or open-loop control.

The supporting structure 16 together with the blank 12 and the at least one forming tool 50 are furthermore designed to be rotatable relative to each other.

With the form of embodiment of the device 10 shown in FIG. 1, the supporting structure 16 together with the blank 12 clamped to it is rotatably mounted, while the at least one forming tool 50 can be moved only along a fixed meridian. For this purpose, the supporting structure 16 together with the blank 12 is designed to be rotated by a drive device 54 about a central axis of rotation 52 of the supporting structure 16. A rotation of the supporting structure 16 together with the blank 12 takes place therefore by means of the drive device 54 according to arrow 56. A connection 58 for applying a vacuum to the mold chamber 18 and for evacuating the mold chamber 18, a supply connection 60 for electrical power and a supply connection 62 for electrical signals, for example using wiper rings (not illustrated in more detail), are located on the central axis of rotation 52.

The axis of rotation 52 of the supporting structure 16 is in this case appropriately horizontally arranged. Without being shown in detail, the axis of rotation 52 can also be equally arranged vertically.

The at least one forming tool 50 can in contrast be moved in two dimensions on a meridian curve fixed in space or can be rigidly mounted by means of two servodrive device 64, 66, that for example interact with a roller drive 68, as shown by the double arrows 70, 72. The roller guide 68 is rigidly mounted.

As can be seen from FIG. 1, the forming tool 50 in the form of a forming or pressure roller is permanently set with respect to the central axis of rotation 52 of the supporting structure 16. The attitude of the forming tool 50 applied to the front face 26 of the blank 12 can of course be individually set with respect to the axis of rotation 52 of the supporting structure 16. The angle or articulation of the forming tool 50 can therefore if necessary be changed or adjusted as required, for example relative to the radius on which the forming tool 50 is actually guided.

The form of embodiment of the device 10 in accordance with the invention shown in FIG. 2 differs from the form of embodiment of the device 10 shown in FIG. 1 mainly in that the supporting structure 16 together with the blank 12 is rigidly mounted, whereas the at least one forming tool 50 can be rotated.

As can be clearly seen in FIG. 2, there is also a total of two forming tools 50 provided as forming or pressure rollers. The deforming and/or forming or concave pressing of the blank 12 into a thin-walled, shell-type body 14 can be substantially accelerated by forming tools 50 that are operated either simultaneously or individually. The forming tools 50 can in this case be offset radially and/or in azimuth, to enable the blank 12 to be machined at different distances simultaneously. Such a synchronous design of several individual deforming and/or forming or pressing steps results in a substantial overall shortening of the particular production interval.

The two forming tools 50 in the form of embodiment of device 10, shown in FIG. 2, are arranged on a traverse 74 and supported by same. The traverse 74 extends diametrically over the complete supporting structure 16 together with the blank 12. The central axis of rotation 52 of the traverse 74 in this case runs vertically.

The two forming tools 50 are therefore each subjected to a rotation of the traverse 74 about their central axis of rotation 52. A rotation of the traverse 74 takes place in the case of the present example of an embodiment of the device 10 shown in FIG. 2 by means of a drive device 76 as shown by arrow 78. At the same time, the two forming tools 50 can each be moved by the two servodrive devices 80, 82 on a meridian curve relative to the traverse 74, in a radial direction corresponding to the double arrow 84 and in a vertical direction corresponding to the double arrow 86.

Because of the rigid mounting design of the supporting structure 16 together with the blank 12, a simple construction is obtained with the form of embodiment of the device 10 shown in FIG. 2. Because the vacuum connection 58, the supply connection 60 for electric power and the supply connection 62 for electric signals do not have to be passed in and through the central axis of rotation 52 of the supporting structure 16 but can instead be rigidly installed, the construction cost can be substantially reduced. The vacuum connection 58, that communicates in a simple manner with the mold chamber 18, is referred to only as an example. Furthermore, all the centrifugal force stresses on the supporting structure 16 and/or the blank 12, and the other components such as the device 20 for clamping the blank 12, the device 30 for warming and/or heating the blank 12, the device 32 for thermal insulation or the device 34 for heat reflection are omitted.

In the case of the form of embodiment of the device 10 shown in FIG. 2, the traverse 74 is guided on a rail arrangement 88. The rail arrangement 88 is supported on a rail supporting structure 90. The rail supporting structure 90 is formed by the pillars 92 anchored in the ground and a carrier ring 94, the end of which is supported by the pillars 92.

The rail arrangement 88 includes a ring gear 96 to which the traverse 74 is attached. The ring gear 96 is itself mechanically connected on the underside to a rail ring 98. The rail ring 98 holds a number of fixed guide rollers 100 that are distributed equidistantly along the inner and outer circumference of the ring, centered precisely on the central axis of rotation 52. Because the rail ring 98 engages in a prism guide or prism-shaped notches 102 in the guide rollers 100, the rail ring 98 and thus the traverse 74 cannot lift out of the rail arrangement 88. Immediately the rail ring 98 circulates, the guide rollers 100 rotate about the axis of the pin 104 anchored in a ring plate 106. The ring plate 106 is in turn supported by the carrier ring 94 of the rail supporting structure 90.

The traverse 74 is rotated by the drive device 76 that in the form of embodiment of the device 10 shown in FIG. 2 is an electric motor. The drive device 76 is attached to the rail supporting structure 90. The drive device 76 drives a pinion 108 that engages in the ring gear 96, with which the traverse 74 is connected via the support 110. As an alternative, the drive device 76 can also be designed as a special stepper motor pulled by magnetic fields circulating in the rail ring 98.

The power supply for the server motor drive devices 80, 82 mounted on the traverse 74 is provided centrally via a current collector shaft 112, that for example is provided with slip rings.

The traverse 74 is, as shown clearly in the form of embodiment of the device 10 illustrated in FIG. 2, to be detached from the ring gear 96 or guide rollers 100 with the prism-shaped notches 102, i.e. the circulating prism-shaped ring, and the support 110 in order to replace the blank 12 by a thin-walled, shell-type body 14 and vice versa, and then can be lifted off by a hoist (not illustrated), for example a workshop crane, and set down at the side of the device 10.

The form of embodiment of the device 10 shown in FIG. 3 differs from that shown in FIG. 2 only in that, additionally, a perforated mating mold 48 is arranged in the mold chamber 18 by means of which a deforming and/or forming or concaving pressing of the mold 12 into a thin-walled, shell-type body 14 is assisted.

In accordance with the example of an embodiment of the device 10 in accordance with the invention, shown schematically in FIG. 4, the traverse 74 can, as shown by the double arrow 114, be rotated on the rail ring 98 about the central axis of rotation 52. The two forming tools 50 can, as shown by the double arrows 116, be moved backwards and forwards along the traverse 74. To replace a blank 12 by a thin-walled, shell-type body 14 and vice versa, the traverse 74 can be moved by rail switches 118 on two straight parallel rails 120 along the double arrow 122. Both straight parallel rails 120 are in this case tangentially connected to the rail ring 98. In this way, the traverse 74 can move sideways into a position in which the blank 12 and/or the thin-walled, shell-type body 14 can be easily lifted out from the supporting structure 16, or lifted into the supporting structure 16, by a hoist (again not illustrated) such as a workshop crane.

FIG. 5 shows a further form of embodiment of the device 10 in accordance with the invention. With the form of embodiment of the device 10 shown in FIG. 5, the supporting structure 16 can be lowered and positioned at a lower level on the side as shown by the double arrow 123, either hydraulically or by using a hoist (not illustrated), e.g., a workshop crane.

In the form of embodiment of the device 10 in accordance with the invention shown in FIG. 6, the supporting structure 16 can be moved in and out through an opening in the rail supporting structure 90 underneath the rails or similar carrier ring 94. This is enabled by the special design of the rail arrangement 88 that is arranged above the level spanned by the blank 12.

FIG. 7 is a schematic of a further different form of embodiment of the device 10 in accordance with the invention. According to this, the traverse 74 with this form of embodiment of the device 10 is again moved on two straight parallel rails 124 or similar, diametrically above the supporting structure 16, together with the blank 12 to be formed. The supporting structure 16 is thus rigidly mounted. The traverse 74 can be moved linearly backwards and forwards along the two parallel rails 124 of the double arrow 126 by means of a drive device 76 (not illustrated) by NC control. The traverse 74 is fitted with at least one forming tool 50 in the form of a forming or pressure roller. The forming tool 50 is actuated by a servodrive device 128 relative to, and vertical to, the traverse 74, and also vertical to the straight parallel rails 124 according to the double arrow 130. Therefore the forming tool 50 can describe a great circle at a defined height on the non-rotating blank 12, corresponding to the interactive control actions of the drive device 76 for the traverse 74 and the servodrive device 128 for the forming tool 50, in such a way that the great circle is formed from a superimposition of a programmed sinusoidal or cosinusoidal feed function in each case. Additional servodrive devices (not illustrated) are necessary for setting the vertical height position or pressing depth and for the inclination or articulation of the forming tool 50 relative to the central axis of rotation 52 of the blank 12 or of the thin-walled, shell-type body 14. Therefore, an additional servodrive device in the form of a stepper motor for the vertical height positioning and a further servodrive device in the form of a geared lever device for the inclination can be provided. For replacing a blank 12 by a thin-walled, shell-type body 14 and vice versa, the traverse 74 can be easily moved and parked outside the supporting structure 16.

Without showing the details, it is of course possible at any time to perform a kinematic reversal of the form of embodiment of the device 10 in accordance with the invention as shown in FIG. 7. Accordingly, the supporting structure 16 can be moved backwards and forwards on two straight parallel rails 124 instead of the traverse 74. The traverse 74 with the weight of the heavy servodrive device 128 and the additional servodrive devices in the form of stepper motors or geared-lever device, however, remain rigidly mounted. The controller of the drive device 76 of the traverse 74, the servodrive device 128 of the forming tool 50 and the additional servodrive devices remains unchanged. The vacuum connection 58 and the supply connections 60, 62 for the electrical power and electrical signals are carried in flexible leads/hoses. Alternatively, a vacuum pump can also be fitted in the supporting structure 16 and the electrical power supplied safely using low voltage, for example via the rails or similar.

Without being shown in detail, the supporting structure 16 can also have a thermally insulated, especially provided with heating surfaces, covering element or similar cover plate 132 for covering the front face 26 of the blank 12 facing away from the mold chamber 18. Accordingly, the blank 12 or shell-type body 14 can be covered on the supporting structure 16 during the heat treatment and its temperature raised to the particular required heat treatment temperatures by means of the existing heating surfaces.

By means of the design features, also not shown in more detail, whereby the supporting structure 16 provided with at least one safety device 136 allocated to the mold chamber 18 for protection against external effects by gaseous and/or liquid coolant, particularly inert gas, preferably argon, nitrogen or water, the blank 12 or shell-type body 14 is enabled to remain clamped on the supporting structure 16 until final removal, to thus undergo further machining and/or heat treatment, for example solution annealing, quenching or age hardening. In this way the blank 12 or the shell-type body 14 after its initial pressing does not need time-consuming removal for the subsequent heat treatment or subsequent time-consuming refitting for the stretching. The heat treatment of the blank 12 can thus be carried out directly in the supporting structure 16 in the fitted condition. The time saving is particularly significant with large blanks 12 or shell-type bodies 14. Accordingly, a shell-type body 14 made of Al 2219, for example, can be solution annealed at 535° C. after initial pressing, quenched, stretched and then age hardened as necessary at 160° C. to 190° C. to achieve the T8× condition.

By means of such a structural embodiment of the device 10 in accordance with the invention, it is easily possible to produce a thin-walled, shell-type body 14 from an essentially flat blank 12 of metal.

The method in accordance with the invention for forming an essentially flat blank 12 of metal into a thin-walled, shell-type body 14 using the device 10 is explained in more detail:

First, the blank 12 is clamped over its circumference 22 on the supporting structure 16 to the mold chamber 18. From the mold chamber 18, the blank 12 is held during the increasing deformation into a thin-walled, shell-type body 14. At the same time, the rear face 24 of the blank 12 facing towards the mold chamber 18 is sealed against the front face 26 of the blank 12 facing away from the mold chamber 18. A vacuum is then applied to the mold chamber 18 sealed by the blank 12. By means of a defined evacuation of the mold chamber 18, the blank 12 is then formed into a thin-walled, shell-type body 14. In doing so, the surface of the blank 12 is stretched with the original thickness being reduced. Contact does not occur between the blank 12 or thin-walled, shell-type body 14, and the supporting structure 16 or its components, because of the limiting and continuous monitoring of the vacuum and a controlled travel movement of the forming tool 50.

Before forming, the blank 12 is brought to an elevated temperature profile by means of the at least one device 30, allocated to the mold chamber 18, for warming and/or heating the blank 12. Furthermore, heat sources such as devices 31 can also be used, that heat the blank 12, if necessary, from both sides 24, 26, raise it quickly to the specified temperatures and maintain it at these temperatures during the deforming and/or forming or concave pressing. In order then to avoid heat losses and at the same time maintain the elevated temperature profile, the blank 12 is furthermore held at the elevated temperature profile by means of the at least one device 32 for thermal insulation and/or the at least one device 34 for heat reflection.

The blank 12 can, as appropriate, be deformed into a thin-walled, shell-type body 14 by means of a mating mold 48 arranged in the mold chamber 18 and, alternatively or in addition, by means of at least one forming tool 50 applied to the front face 26 of the blank 12. At least one forming or pressure roller and/or a pressure ball is/are preferably used as the forming tool 50. In the latter case, the pressure ball is more appropriately hydrostatically mounted.

When applying the forming tool 50 to the front face 26 of the blank 12, it is especially advantageous if the forming tool 50 is moved relative to the blank 12 from the circumference 22 to the centre and/or from the centre to the circumference 22. The forming tool 50 in this case is preferably controlled by a (metal) template or numerically, using closed-loop and/or open-loop control.

Before forming the blank 12 into a thin-walled, shell-type body 14 by means of the device 10 in accordance with the invention, it is especially advantageous if the blank 12 is made from at least two separate surface elements. The at least two separate surface elements can in this case be joined to form a single unit by means of tungsten inert gas (TIG) welding, metal inert gas (MIG) welding, friction stir welding (FSW), electronic beam (EB) welding, laser welding, plasma welding or any other suitable method of welding. In this way, large blanks 12 that can then be deformed and/or formed or concave-pressed into a thin-walled, shell-type body 14 can also be produced.

If the blank 12 is made of several separate surface elements, it can be particularly advantageous if the blank 12 is soft annealed in a conventional manner before forming.

The blank 12 is, in a preferred manner, pre-contoured by chip removal, especially by turning, milling and/or grinding, before forming into a thin-walled, shell-body 14. In doing so, a predetermined wall thickness distribution of the blank 12 is set to obtain a required final wall thickness of the thin-walled, shell-type body 14. In this connection, it is particularly useful if the blank 12 is contoured on its rear face 24. In the case of an application to the front face 26 of the blank [12], a smooth movement of the forming tool 50 is thus guaranteed.

Furthermore, it is useful if the blank 12 before forming and/or stretching into a thin-walled, shell-type body 14 is provided with openings, perforations or similar cutouts by chip removal that then by means of covers, particularly a film, are temporarily vacuum-sealed. The chip removal in this case can be by means of turning, milling and/or grinding, with suitable openings, perforations or similar cutouts being made particularly in the pole area or in the centre of the blank 12.

Before the blank 12 is deformed and/or formed or concave pressed into the thin-walled, shell-type body 14 by means of the device 10 in accordance with the invention, it can be advantageous to subject the blank 12 to further preparatory processing steps. It is thus conceivable to preform the blank 12 if required and/or prepress, solution anneal, quench to obtain condition T4, then cold form, age harden in an oven and bring to condition T8.

In order to obtain the dimensional accuracy, it is very advantageous to subject the blank 12 to continuous measurement during the deforming into the thin-walled, shell-type body 14.

By means of the method and the device 10 in accordance with the invention, domes, for example for the fuel tank of the Ariane 5, are meanwhile being manufactured that have a diameter of 5.4 m and above and wall thickness of about a maximum of 7 mm on the edge and approximately 3.3 mm in the area of the shell-type body 14.

The invention is not limited to the forms of embodiment of the device 10 in accordance with the invention shown. It is thus easily possible to fit the supporting structure 16 with a device terminating in the mold chamber 18 for the supply of a protective gas (not illustrated). In this way, the oxidation of the blank 12 or thin-walled, shell-type body 14 is further stemmed during the warming and/or heating or further processing or heat treatment, in order to minimize the subsequent surface cleaning at the same time.

The invention claimed is:

1. Device for forming a flat blank (12) of metal into a thin-walled, shell-type body (14), comprising:

a supporting structure (16) forming a mold chamber (18) that holds the blank (12) during formation into the thin-walled, shell-type body (14);

a device (20) allocated to the structure (16) for clamping the blank (12) at its circumference (22) to the supporting structure (16), that seals the reverse face (24) of the blank (12) facing towards the mold chamber (18) against the front face (26) of the blank (12) facing away from the mold chamber (18);

a device (28) allocated to the mold chamber (18) and communicating with the mold chamber (18) for applying a vacuum and evacuating the mold chamber (18); and at least one forming tool (50) applied to the front face (26) of the blank (12) allocated to the supporting structure (16).

2. Device in accordance with claim 1, wherein the supporting structure (16) for forming the mold chamber (18) is shaped as one of the following hollow shapes: a cup, pot, dish, cone, or truncated cone.

3. Device in accordance with claim 1, wherein the supporting structure (16) has at least one device (30) that radiates heat to the mold chamber (18) for heating the blank (12).

4. Device in accordance with claim 1, wherein the supporting structure (16) has at least one device (32) allocated to the mold chamber (18) for thermal insulation.

5. Device in accordance with claim 1, wherein the supporting structure (16) has at least one device (34) allocated to the mold chamber (18) for heat reflection.

6. Device in accordance with claim 1, wherein the device (20) for clamping the blank (12) includes a pressure ring (42), a clamping ring (44), and a sealing ring (46) between the pressure ring (42) and clamping ring (44).

7. Device in accordance with claim 1, wherein the supporting structure (16) is fitted with a device for reducing radial thermal expansion (47) between the blank (12) and the device (20) for clamping the blank (12).

8. Device in accordance with claim 7, wherein the device (20) for clamping the blank (12) can be moved radially and/or circumferentially relative to the supporting structure (16).

9. Device in accordance with claim 1, wherein at least one forming tool comprising at least one of a, forming roller, pressure roller or, hydrostatically-mounted pressure ball, is/are allocated to the supporting structure (16) applied to the front face (26) of the blank (12).

10. Device in accordance with claim 9, wherein the at least one forming tool (50) applied to the front face (26) of the blank (12) is controlled by a template or numerically using closed-loop and/or open-loop control.

11. Device in accordance with claim 9, wherein the at least one forming tool (50) applied to the front face (26) of the blank (12) is individually adjustable in its application.

12. Device in accordance with claim 1, wherein the supporting structure (16) has a thermally insulated covering element or similar cover plate (132) for covering the front face (26) of the blank (12) facing away from the mold chamber (18).

13. Device in accordance with claim 1, wherein the supporting structure (16) is provided with at least one safety device (136) allocated to the mold chamber (18).

14. Device in accordance with claim 1, wherein the supporting structure (16) has at least one device for cooling (134), at least one of the blank (12) and the thin-walled, shell-type body (14) over the reverse face (24) facing towards at least one of the mold chamber (18) and the front face (26) facing away from the mold chamber (18), of the blank (12) or thin-walled, shell-type body (14).

15. Device in accordance with claim 1, wherein the device (28) for applying a vacuum and evacuating the mold chamber (18) has a vacuum connection (58) that extends into and through the axis of rotation (52) of the supporting structure (16) and/or communicates with the mold chamber (18).

16. Device in accordance with claim 3, wherein the at least one device (30) is an electrically operated light lamp heater, infrared radiation heater, induction heater or circulation-type heater with a circulating heat carrier including one or more of water, oil, molten salt or sodium.

17. Device in accordance with claim 5, wherein the at least one device (34) is a reflecting multi-screen reflector film.

18. Device in accordance with claim 9, wherein at least two of a forming roller, pressure roller or hydrostatically-mounted pressure ball, are allocated to the supporting structure (16) applied to the front face (26) of the blank (12).

19. Device in accordance with claim 12, wherein the thermally insulated covering element (132) is provided with heating surfaces.

20. Device in accordance with claim 13, wherein the at least one safety device (136) is allocated to the mold chamber for protection against external influences by gaseous and/or liquid coolant, including inert gas such as argon or nitrogen, or water.

21. Device in accordance with claim 14, wherein the at least one device for cooling (134) is for quenching.

22. Device in accordance with claim 1, characterized in that the supporting structure (16) is provided with a device for active cooling.

23. Device in accordance with claim 1, characterized in that a device for applying protective gas to the blank (12), that is especially arranged in the mold chamber (18) or communicates with the mold chamber (18) for its supply, is allocated to the supporting structure (16).

24. Device in accordance with claim 1, characterized in that a device (36), that includes the thermocouples (38) and/or a thermal imaging camera (40), for monitoring the temperature of the mold chamber (18) and/or of the blank (12) at individual points and/or over the complete area, is allocated to the supporting structure (16) and/or the blank (12).

25. Device in accordance with claim 1, characterized in that a perforated mating mold (48) arranged in the mold chamber (18) for holding and supporting the blank (12) to be deformed into the thin-walled, shell-type body (14) is allocated to the supporting structure (16).

26. Device in accordance with claim 9, characterized in that the at least one forming tool (50) applied to the front face (26) of the blank (12) is held by a traverse (74) allocated to the supporting structure (16), with the supporting structure (16) together with the blank (12) and traverse (74) being moveable, especially rotatable, relative to each other.

27. Device in accordance with claim 9, characterized in that the supporting structure (16) together with the blank (12)

and the at least one forming tool (50) are designed to be rotatable relative to each other.

28. Device in accordance with claim 27, characterized in that the supporting structure (16) together with the blank (12) is designed to be rotatable and that the at least one forming tool (50) can be moved essentially in two dimensions along a fixed meridian.

29. Device in accordance with claim 28, characterized in that the supporting structure (16) together with the blank (12) can be rotated by a drive device (54) about a central axis of rotation (52) of the supporting structure (16) and that the at least one forming tool (50) can be moved by two servodrive devices (64, 66) in two dimensions on a meridian curve fixed in space.

30. Device in accordance with claim 27, characterized in that the supporting structure (16) together with the blank (12) is of rigidly mounted design and that the at least one forming tool (50) is designed to be rotatable.

31. Device in accordance with claim 30, characterized in that the at lest one forming tool (50) is arranged on a traverse (74) extending diametrically over the supporting structure (16) together with the blank (12) and guided in a rail arrangement (88) or similar, can be rotated by a drive device (76) of the traverse (74) about a central axis of rotation (52) and can be moved by two servodrive devices on a meridian curve relative to the traverse (74).

32. Device in accordance with claim 26, characterized in that the axis of rotation (52) of the supporting structure (16) or of the traverse (74) is arranged horizontally or vertically.

33. Device in accordance with claim 26, characterized in that the traverse (74) for replacing a blank (12) by a thin-walled, shell-type body (14), and vice versa, can be detached from circulating supports (110) or a circulating rail ring (98) or from rails or similar and lifted off by means of a hoist.

34. Device in accordance with claim 26, characterized in that the traverse (74) for the replacement of a blank (12) by a thin-walled, shell-type body (14), and vice versa, can be moved by rail switches (118) on two straight parallel rails (120) that connect tangentially to a rail ring (98).

35. Device in accordance with claim 26, characterized in that the supporting structure (16) for replacement of a blank (12) by a thin-walled, shell-type body (14), and vice versa, can be hydraulically lowered and moved to the side.

36. Device in accordance with claim 26, characterized in that the supporting structure (16) for replacing a blank (12) by a thin-walled, shell-type body (14), and vice versa, can be moved in and out of an opening in the rail supporting structure (90) underneath the rail or similar supporting carrier ring (94).

37. Device in accordance with claim 26, characterized in that the traverse (74) can be moved linearly forwards and backwards on two straight parallel rails (124) or similar over the rigidly mounted supporting structure (16) and carries the at least one forming tool (50) that can be moved forward and backwards along the traverse (74) in such a manner that the at least one forming tool (50) can be applied to the blank (12) in circles or spiral tracks with a constant angle of inclination and at defined height positions.

38. Device in accordance with claim 26, characterized in that the supporting structure (16) is moved linearly forwards and backwards on two straight parallel rails (124) or similar under the rigidly mounted supporting structure (16) and the traverse (74) carries the at least one forming tool (50) that can be moved lengthwise backwards and forwards along the traverse (74) in such a way that the at least one forming tool (50) can be applied to the blank (12) in circles or spiral tracks with a constant angle of inclination and at defined height positions.

* * * * *